US005649801A

United States Patent [19]

White

[11] Patent Number: 5,649,801

[45] Date of Patent: Jul. 22, 1997

[54] DEVICE AND METHOD FOR UNLOADING LARGE BULK BAGS

[75] Inventor: Harold R. White, New Lenox, Ill.

[73] Assignee: ABR Corporation, New Lenox, Ill.

[21] Appl. No.: 573,152

[22] Filed: Dec. 15, 1995

[51] Int. Cl.[6] ..... B65B 69/00

[52] U.S. Cl. ..... 414/412; 414/411; 414/21; 414/415; 414/403; 414/786; 222/105; 83/929; 53/381.2; 198/861.1

[58] Field of Search ..... 177/52; 414/411, 414/412, 403, 21, 560, 414, 415, 422, 404, 786; 53/381.2; 83/929, 438; 254/362; 212/283, 330, 336; 222/105, 181.1, 181.2, 196; 198/812, 832.3, 861.1

[56] References Cited

U.S. PATENT DOCUMENTS

| | | | |
|---|---|---|---|
| 3,853,235 | 12/1974 | Lambert et al. | 414/412 |
| 4,768,915 | 9/1988 | Fujioka | 414/403 X |
| 4,966,311 | 10/1990 | Taylor | 414/415 X |

FOREIGN PATENT DOCUMENTS

| | | | |
|---|---|---|---|
| 2389471 | 1/1979 | France | 414/412 |
| 1297550 | 6/1969 | Germany | 414/412 |
| 307031 | 12/1988 | Japan | 414/412 |
| 352627 | 12/1992 | Japan | 414/412 |
| 483313 | 12/1975 | U.S.S.R. | 414/412 |

*Primary Examiner*—Frank E. Werner
*Attorney, Agent, or Firm*—Hill, Steadman & Simpson

[57] ABSTRACT

A device for emptying the contents of a bag into a hopper includes an arrangement for lifting the bag to a position higher than the top edge of the hopper, an arrangement for transporting the bag from an intermediate position in a frame to an unloading position including a retractable conveyor as the upper end of the bag is still engaged by the arrangement for lifting, an arrangement of cutters for cutting the lateral sides of the bag and the leading side of the bag to form a flap connected to the bag by the trailing side which flap will be opened by retracting the forward end of the retractable conveyor to allow the flap to open to discharge the contents as the bag is maintained by the arrangement for lifting over the hopper.

12 Claims, 9 Drawing Sheets

DEVICE AND METHOD FOR UNLOADING LARGE BULK BAGS

BACKGROUND OF THE INVENTION

The present invention is directed to a device and process for unloading large bulk bags having an upper end and a bottom interconnected by a continuous sidewall, which bags are commonly known as flexible intermediate bulk containers.

Bulk bags have been developed to fill the need for economical shipping containers in the size range between individual paper bags and bulk shipment. These containers and the equipment used to fill and discharge them are designed to handle dry, free-flowing granular material. The range of materials being transported has expanded to include fine powders, semi-dry solids and compactable solids. Discharge problems that cannot be resolved by the conventional method of shaking and vibrating the bulk bag have begun to appear. Also, the rate of flow through the bottom spout of the bag may be too slow to meet process or unloading requirements. In many cases, bottom discharge spouts become plugged and the material will not discharge.

To overcome these problems, it is necessary to cut away the bottom of the bulk bag to remove the material. This method creates a "dump situation", which is unsatisfactory for safety and health reasons, particularly if the content is a hazardous material.

SUMMARY OF THE INVENTION

The object of the present invention is to provide a device and method for cutting the bottom of large bulk bags while providing a controlled discharge of the solid from the bulk bag for different applications, does not require personnel to be in contact with the bag during the emptying thereof and does not create a dump situation and is, therefore, satisfactory for safety and health reasons.

To accomplish these goals, the device of the present invention comprises a frame having a portion positioned over a discharge zone, the frame has a conveyor means for transporting a bag from a loading position or station outside of the frame to an intermediate position in the frame and then to an unloading position over the discharge zone and, finally, to a removal position or station outside of the frame. The conveyor means include lift means for engaging the upper end of the bag, for hoisting the bag and for holding the bag in an erect position, said conveyor means also includes a retractable conveyor means for supporting the bottom of the bag and transporting the bag from the intermediate position to the unloading position and includes an end portion which is disposed under the bag at the intermediate position and is movable with the bag into the unloading position, and cutter means being positioned in the frame adjacent the unloading position for cutting the sidewall of the bag adjacent the bottom to form an opening flap at the bottom of the bag which is attached along a trailing edge or side of the bag.

In operation, the lifting means lifts the bag from the loading station and then transports the bag to the intermediate station where it is placed upon the retractable conveyor. Once on the retractable conveyor, the bag held in the upright position by the lifting means is transported to the unloading position where the sidewalls are cut on the leading side and the two lateral sides of the bag to form the flap attached along the trailing edge or side of the bag. Then, by retracting the end portion of the retractable conveyor means, a peeling action occurs between the conveyor and the flap to allow the flap to open in a controlled manner to discharge the contents into the discharge zone, which may be a hopper. Once the bag has been emptied, it is then transported by the conveyor means to the removal position or station where it can be removed from the lift means.

If desired, a vibrating device can be incorporated in the lift means to shake the bag to ensure the removal of all of its contents.

The cutter means are preferably two stationary rotation cutters or saws located on the frame so that as the bag is transported into the unloading position, the lateral sides of the bags are cut to form side cuts. Once the bag has reached the unloading position, a third rotating cutter is moved across the leading side of the bag to interconnect the side cuts and to form a cut extending on three adjacent sides to form the flap, which is still attached to the bag by the trailing sidewall.

In order to obtain a controlled peeling, the retractable conveyor includes a fixed frame and a movable sub-frame portion or carriage supported in the fixed frame. Two idler rolls are mounted in the fixed frame for rotation and two idler rolls are carried on the movable sub-frame. The device includes a continuous belt which is looped around the two idler rolls in the fixed frame and the two idler rolls in the sub-frame. In addition, a retracting or first brake is mounted on the fixed frame in a position to engage the belt extending between the two idler rolls on the movable sub-frame and a second brake is mounted on the fixed frame to engage the belt extending between the two idler rolls of the fixed frame. Finally, the retractable conveyor includes means for shifting the movable sub-frame or carriage relative to the fixed frame to extend the end from a retracted position to an advanced position. During movement from the retracted position to the advanced position, the second brake is actuated so that the belt moves relative to all of the idler rolls and advances an object on the belt twice the distance of movement of the sub-frame. When retracting the sub-frame, the second brake is released and the retracting or first brake is actuated so that the belt does not move relative to the two idler rolls on the fixed frame, which causes a peeling of the belt progressively from underneath the bag supported in the unloading position to progressively open the bottom flap formed by the cutting means from the leading side. In order to support the weight of the bags, it is preferable that the movable sub-frame includes support rollers positioned under the upper run of the belt.

Other advantages and features of the invention will be readily apparent from the following description of the preferred embodiments, the drawings and claims.

DESCRIPTION OF THE PREFERRED EMBODIMENTS

Figure 1:
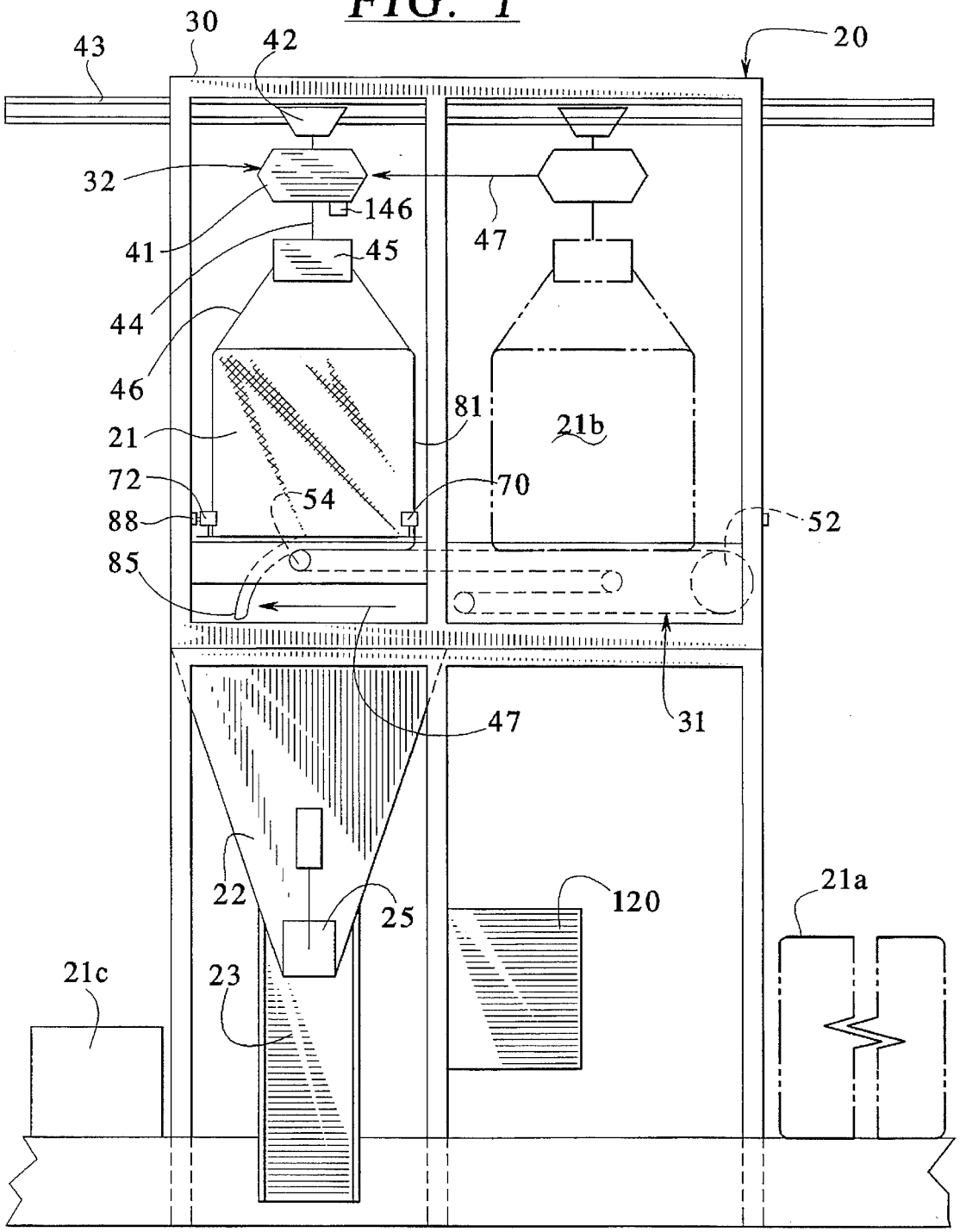
FIG. 1 is a side elevational view of the device for unloading bulk bags in accordance with the present invention.
Figure 2:
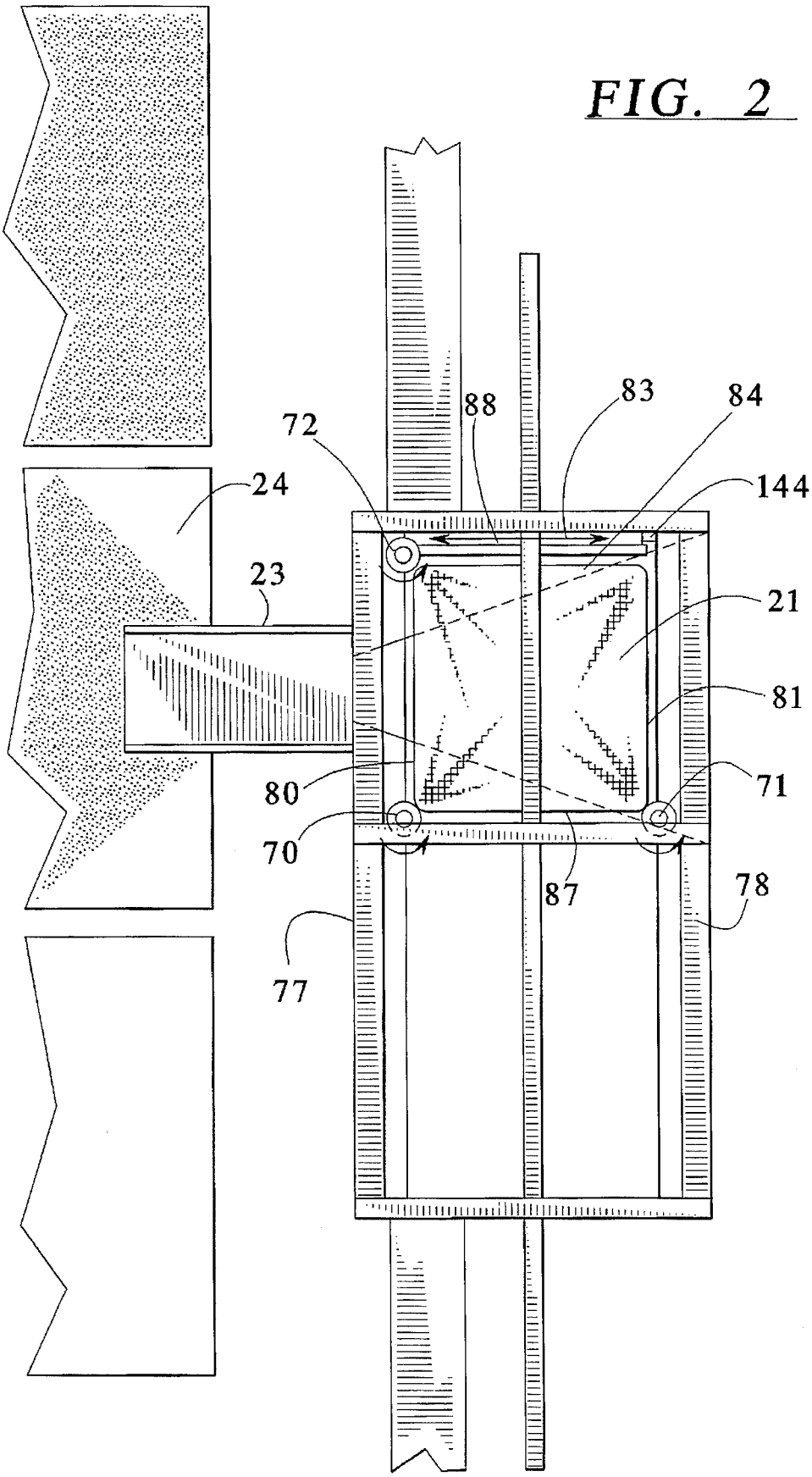
FIG. 2 is a top plan view of the device of FIG. 1.
Figure 3:
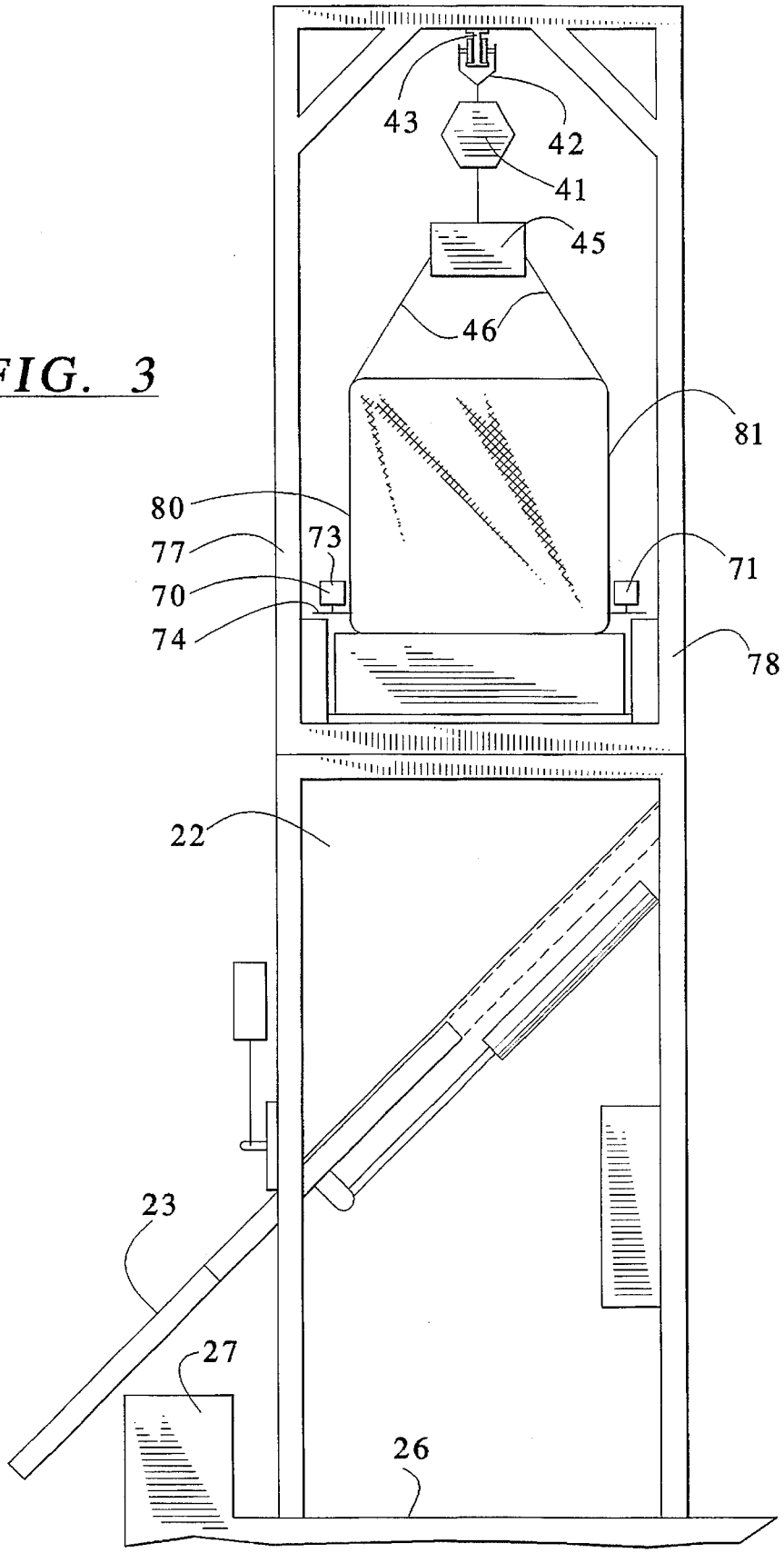
FIG. 3 is an end view of the device of FIG. 1.

The principles of the present invention are particularly useful when incorporated in a device, generally indicated at 20 in FIGS. 1, 2 and 3, for unloading bulk bags 21 into a discharge zone, which is illustrated as a hopper 22. The hopper 22 has a chute 23 which can discharge into bins or pits 24 (FIG. 2) when a door 25 (FIG. 1) is opened. As illustrated, the device 20 has a frame 30 which is composed of I-beams and structural members which support the hopper 20 above ground level illustrated at a surface 26 in FIG. 3. It should be pointed out that while the frame is illustrated as being fixed on the surface 26, it could be mounted on tracks for movement along a curb 27.

The device 20 also includes a conveyor means which is designed to move bags, such as 21, from a loading position or station illustrated by the bag 21*a* which is outside of the frame 30 into an intermediate position 21*b* within the frame. Once in the frame, the bags are then shifted or transported to the unloading position which is above the hopper 22 and, after complete removal of material from the bag 21, it is then transported to a removal position outside of the frame, such as the point shown by 21*c* in FIG. 1. The conveyor means includes two separate conveyor units, the first being a retractable conveyor, generally indicated at 31 in FIG. 1, and the second being a trolley arrangement, generally indicated at 32 in FIG. 1.

The trolley arrangement 32 includes a trolley hoist 41 which is mounted on a carrier 42 that travels on a track 43 mounted in an upper part of the frame 30. The hoist 41 has a cable 44 extending to a bag holder 45 which preferably includes a vibrating device, which will be described hereinafter. The bag holder 45 engages the bag and, as illustrated, is engaging straps 46 of the bag 21.

The trolley arrangement, thus, enables lifting a bag, such as 21*a*, in the loading position or station and raising it to the upper level of the retractable conveyor. Then, the carrier 42 moves along the track 43 to enable positioning the bag at the intermediate position above the retractable conveyor, whereupon the hoist 41 lowers the bag to rest on the conveyor, but maintains the bag in the erect position. The trolley arrangement moves with the bag as it is transported from the intermediate position to the unloading position in the direction of arrow 47. When the retractable conveyor is withdrawn, then the bag is supported by the trolley arrangement over the hopper as the contents are poured therefrom. By actuating the vibrator in the holder 45, the contents are completely shaken from the bag. Subsequent to emptying the bag, the trolley arrangement is then shifted in the direction of arrow 47 out of the frame and then the hoist 41 lowers the empty bag down to the removal station, which may have a container or cart for receiving the emptied bags.

Figure 4:
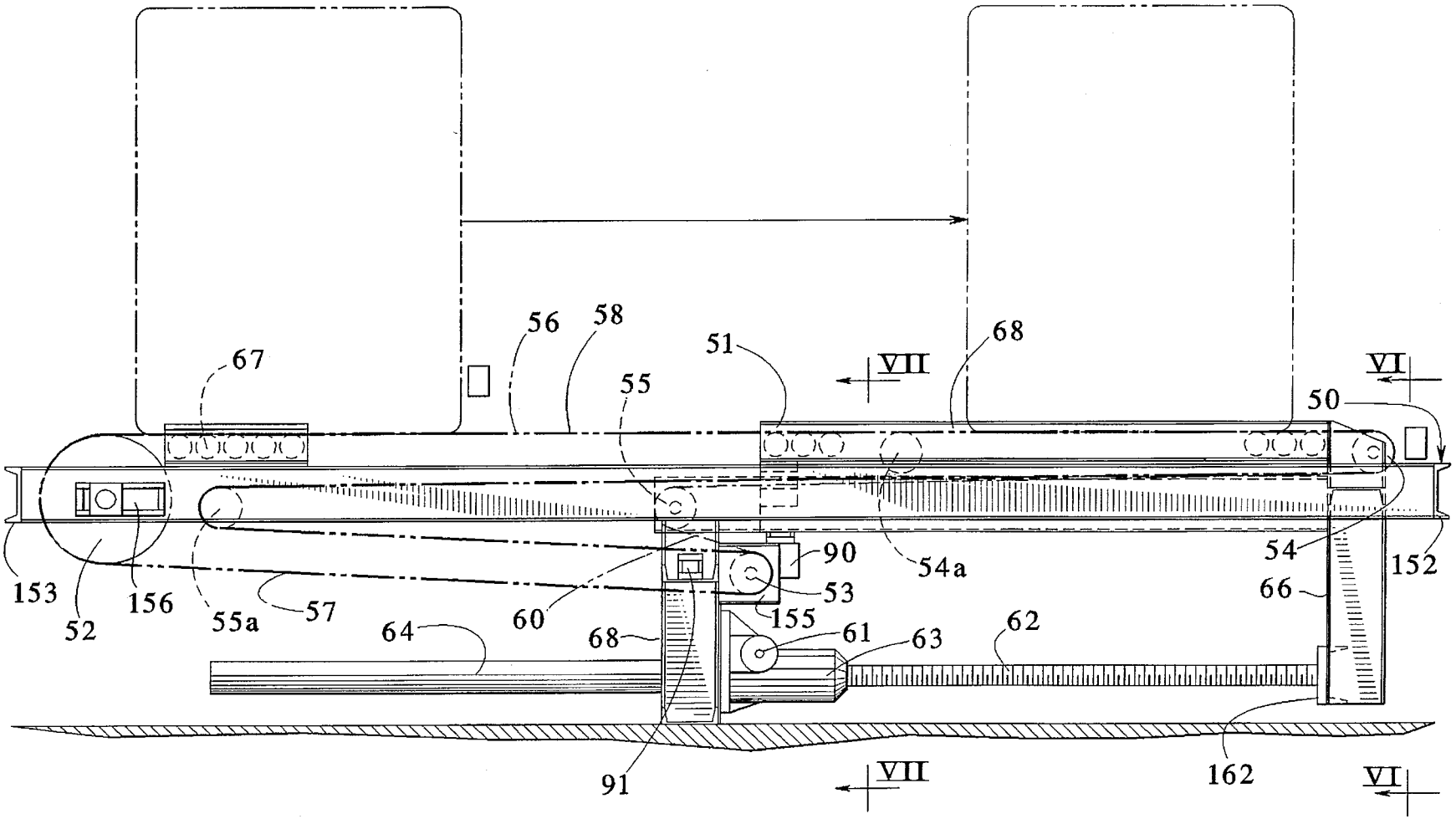
FIG. 4 is an enlarged side view of the retractable conveyor frame illustrated in the extended position with the retracted position being shown by broken lines.

The retractable conveyor 31, as illustrated in FIGS. 1 and 4, has a frame 50 which is mounted in the frame 30 of the device. A sub-frame or carriage 51 is mounted for sliding movement in the frame from the extended position illustrated in FIG. 4 to a retracted position. The frame 50 of the conveyor supports a large idler roll 52 and a smaller idler roll 53, while the carriage 51 supports an end idler roll 54 and a second idler roll 55. A continuous belt 56 is looped around the various rolls so that, as illustrated in FIG. 4, a run 57 extends from the stationary small idler roll 53 to the stationary large idler roll 52 of the main frame. The belt has a run 58 that extends from the large idler roll 52 to the end idler roll 54 of the movable carriage 51. From there, the belt has a run 59 extending from the idler roll 54 to the idler roll 55 on the movable carriage and a final run 60 extending between the idler roll 55 and the stationary idler roll 53. The retractable conveyor includes a means for shifting the carriage 51 in the frame 50, which is best illustrated as an acme screwdrive 63 connected to a reversible motor 61, a screw or threaded shaft 62 extending through the screwdrive 63 which converts the rotation of the motor 61 to advance or retract the screw, depending on the direction of movement of the motor, and a cover 64 for receiving the threaded screw when it is in the retracted position. The end of the screw 62 is connected to a front member 66 of the carriage 51.

Since the bag, such as 21, can be in the order of 2,000 to 3,500 pounds, the portion of the belt in the run 58 needs supplemental support. This is accomplished, as illustrated in FIG. 4, by a set of support rollers 67 which are mounted on the main frame 30 adjacent the idler roll 52 and by a set of support rollers 68 mounted on the upper portion of the carriage frame 51 to move with the carriage. When in the retracted position, the carriage 51 is moved so that the idler roll 55 is in a position 55*a* shown in broken lines in FIG. 4, and the end idler roll 54 is in the position 54*a*. As a result of the movement of the carriage, the set of support rollers 68 of the carriage 51 will be in abutting contact with the stationary support rollers 67.

In order to form the flap in the bottom of the bag 21, cutting means are provided. As illustrated, these are preferably rotating cutters 70, 71 and 72. Each of these cutters, such as 70, is provided with a motor 73 rotating a circular cutting blade 74, such as a saw blade, which will penetrate through the sidewalls of the bag. The cutters 70 and 71 are stationary cutters, with the cutter 71 being mounted on a side of the frame 77 and the cutter 71 being mounted on the side of the frame 78 so that as the bag passes from the intermediate position to the unloading position, it is passed between the two stationary cutters 70 and 71 with the sidewalls 80 and 81 being cut. The bag is preferably a prismatic-shaped bag and is illustrated as a cube. Once the bag has reached the unloading position, the cutter 72, which is mounted for reciprocal movement along a direction of double-arrow 83, it will move to cut the leading side 84 of the bag to interconnect the cuts on the side. The cuts on the sides form a flap 85 which includes a bottom 86 and immediately adjacent portions of the sidewall and the flap is held by a trailing side 87 of the bag 21. As illustrated in FIG. 1, the cutter 72 is mounted on a carriage that moves along a frame or member 88 in the direction 83. Preferably, the carriage is on a transverse screwdrive similar to the screwdrive described hereinabove with regard to the carriage for the retractable conveyor.

Figure 5:
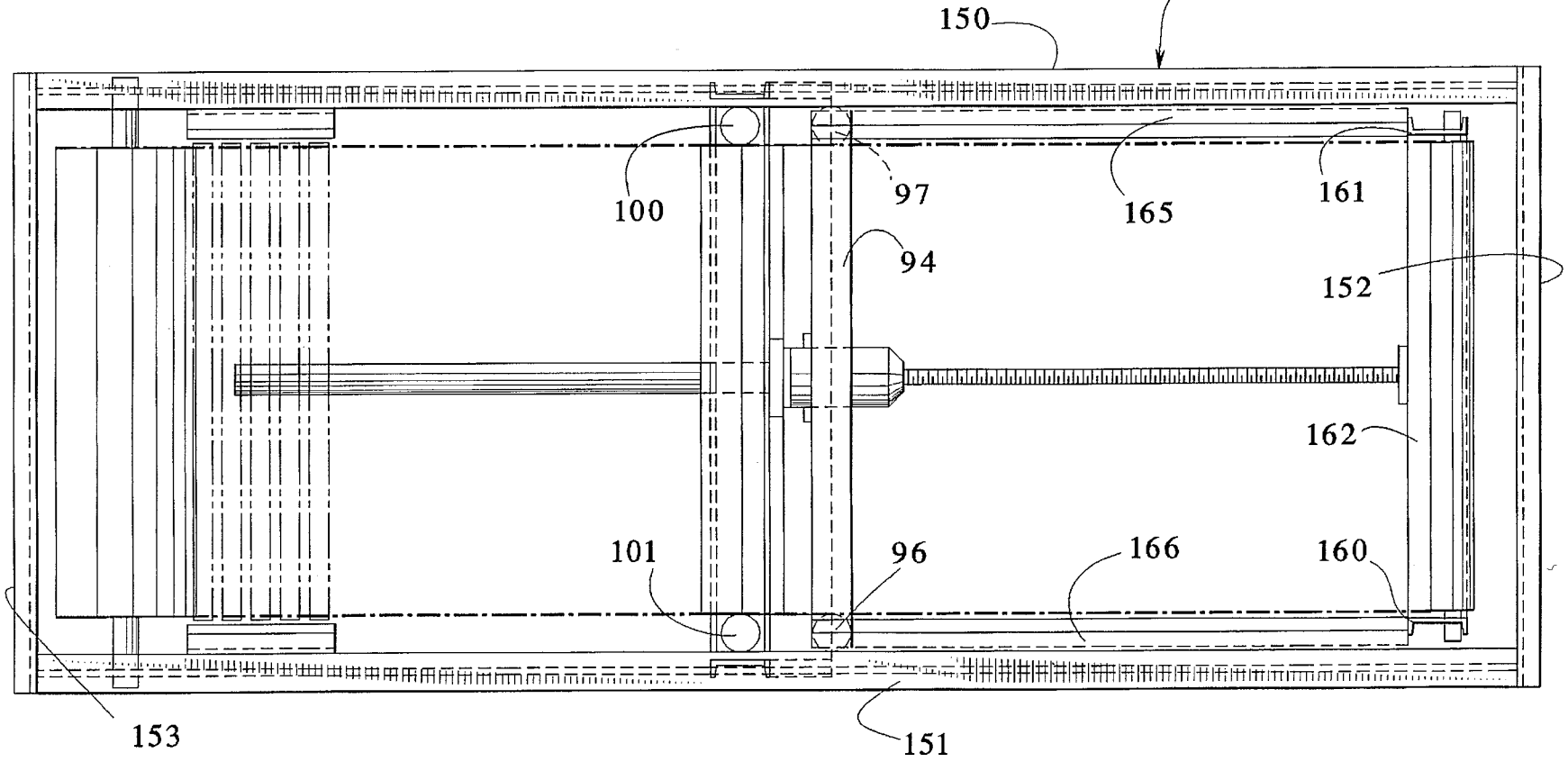
FIG. 5 is a top elevational view of the frame of the conveyor of FIG. 4.
Figure 6:
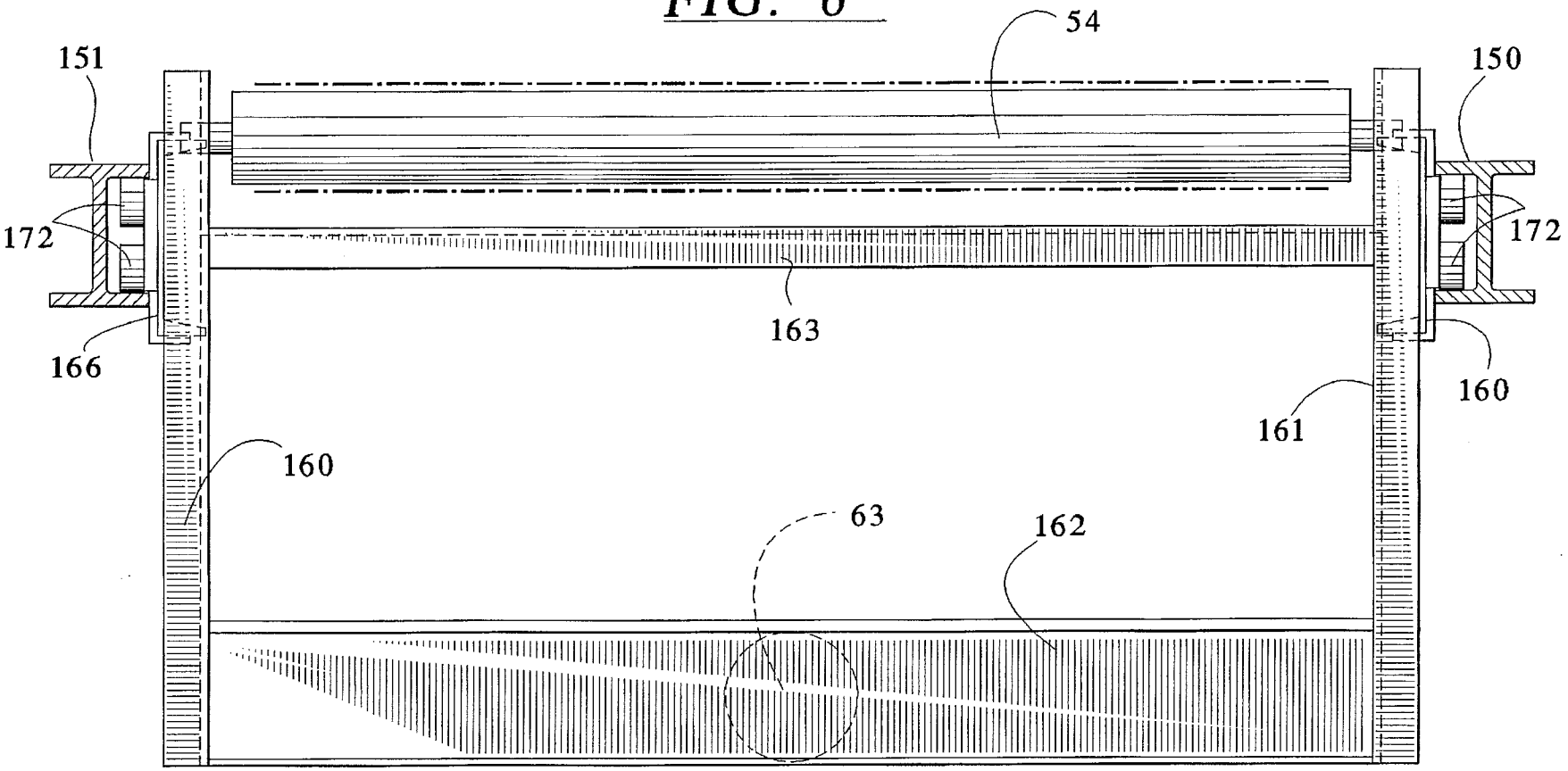
FIG. 6 is a view taken along the line VI—VI of FIG. 4.
Figure 7:
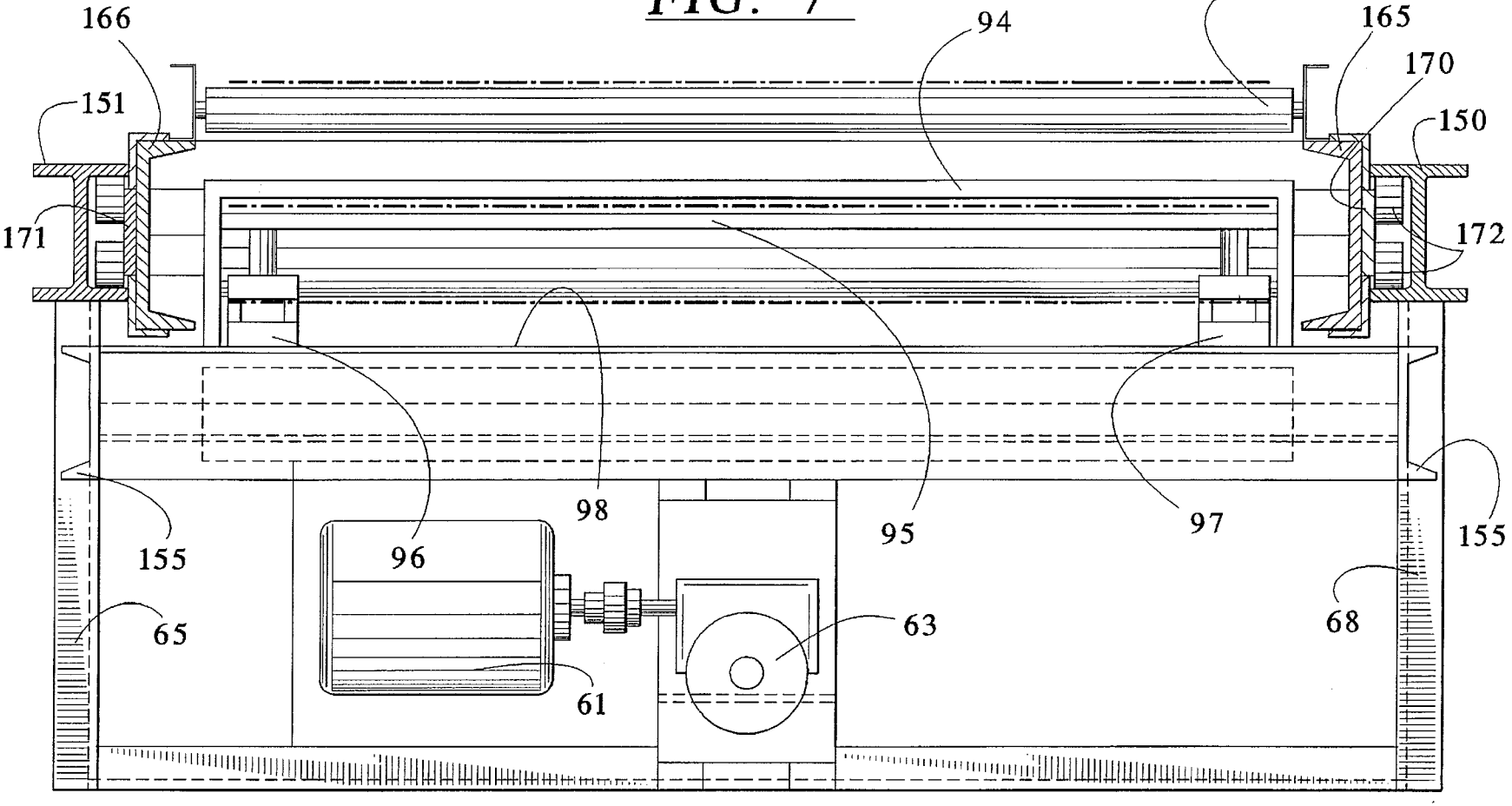
FIG. 7 is a cross sectional view taken along the lines VII—VII of FIG. 4.

The retractable conveyor also includes a first brake mechanism 90 and a second brake mechanism 91. The second brake mechanism 91 is mounted on the stationary frame member 68 and is positioned to pinch or engage a portion of the run 57 extending between the rolls 53 and 52 so that when the brake mechanism 91 is actuated, the belt will not move relative to the idler pulleys 53 and 52 of the fixed frame of the conveyor. The first brake mechanism 90 is also mounted on the fixed frame in a position to engage the run 59 extending between the idler rolls 54 and 55 of the carriage 51. Each of the brake means, such as the brake means 90, includes an upper brake bar 94 and a lower brake bar 95, as illustrated in FIG. 7, with the lower brake bar being shifted in a vertical direction by actuators 96 and 97, while the upper brake bar 94 is secured by members to a frame member 98 of the main frame 50. In FIG. 5, the upper bar 94 of the first brake means 90 and the pneumatic actuators 100 and 101 for the second brake means 91 are illustrated. It should be noted that the actuators are disposed on the sides of the conveyor belt so that the belt can pass therebetween.

The main frame 50 of the retractable conveyor 31 is a rectangle formed by a pair of side beams 150 and 151 which are interconnected by end channels 152, 153. As shown in FIG. 4, approximately midway between the end channels 152 and 153, a vertical member 68 is formed which supports the idler 53 on members 155, which support the member 98 for the forward or first brake. Each of the idlers, such as 53, are mounted by bearings, and the idler 52 is mounted by an adjustable bearing 156 on each side to allow compensation for changes in the length of the belt.

The carriage 51, as illustrated in FIGS. 4, 5, 6 and 7, has a front member 66 which has a box-like shape formed by a pair of upright members 160 and 161 interconnected by a lower member 162, which receives the thrust bearing for connection to the screw 62. Adjacent the roll path, a channel 163 completes the formation of the front member. The front member is joined to two side channels to form a rectangular frame. The support rollers 68 are mounted on an upper edge of these channels 165, 166. The channels 165 and 166 on each corner or end is provided with a plate, such as a plate 170 and 171, and each of these plates supports two rollers, such as 172 for the plate 170, which engage surfaces of the I-beam, such as 150, to form a rolling support for the carriage to move between the retracted position and the extended position.

Figure 9:
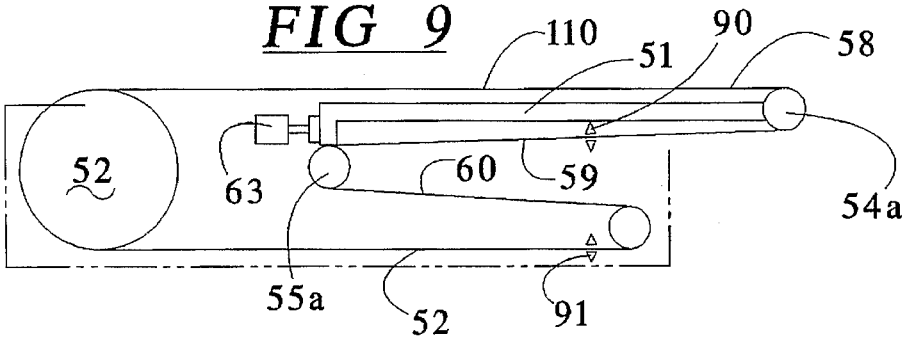
FIG. 9 is a diagrammatic view of the retractable conveyor in the retracted position.
Figure 10:
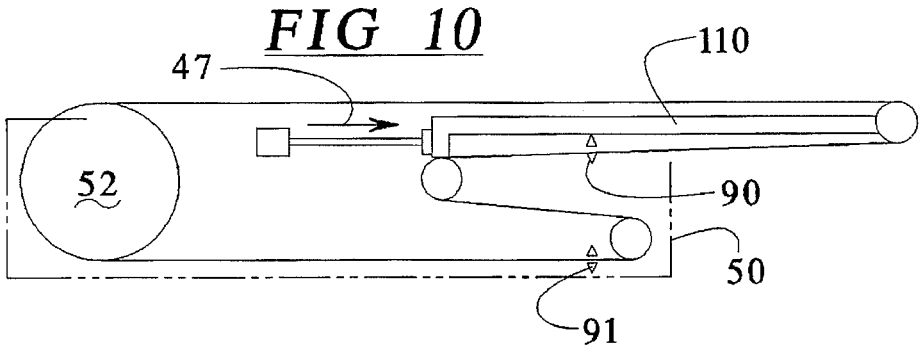
FIG. 10 is a diagrammatic view with the conveyor in a partially extended position.

Operation of the retractable conveyor is illustrated schematically in FIGS. 9, 10, 11 and 12. In FIG. 9, it is in the starting position or retracted position, with the carriage 51 in the retracted position so that the lead pulley or end roll 54 is in the position 54*a* and the other idler roll 55 is in the position 55*a*. By actuating the brake 90 to pinch the run 59 and the brake 91 is in a released position so that the run 57 can pass therethrough. As the carriage 51 is moved by the screwdrive 63 in the direction of arrow 47, the belt engaged by the brake 90 is locked in a relatively fixed position to the fixed frame 50 and, therefore, the belt is free to move around each of the idler rolls 52–55 as the run 60 begins to decrease in length. As a result of the movement of the carriage, a point 110 on the run 58 will move twice the distance of the movement of the carriage. Thus, after moving to an intermediate position shown in FIG. 10, the point 110 will be moved, as illustrated. When moved to the full extension position of FIG. 11, the point 110 will now be adjacent the end roll 54.

Figure 11:
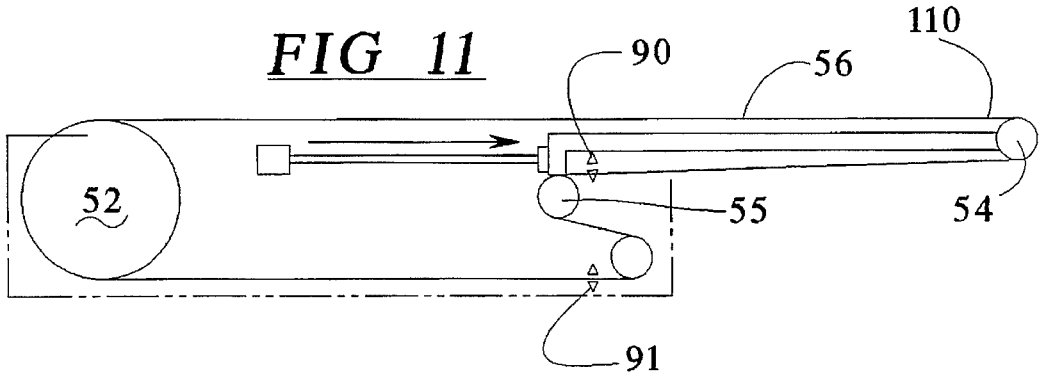
FIG. 11 is showing the conveyor in the final extended position.
Figure 12:
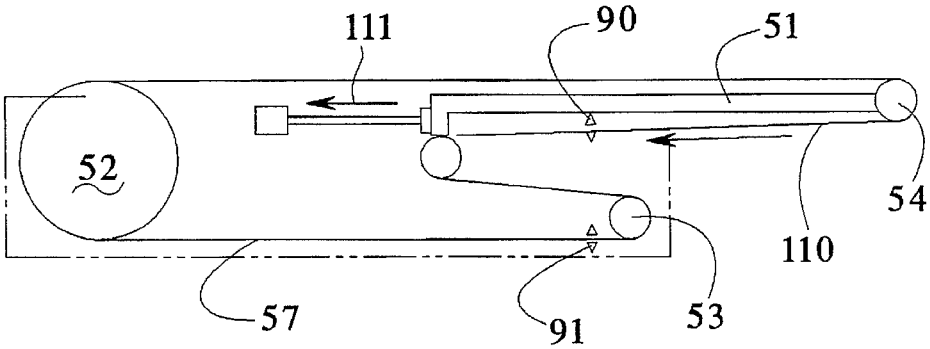
FIG. 12 is showing the conveyor being moved back from the extended position toward the intermediate position, such as shown in FIG. 10.

To move from the retracted position illustrated in FIG. 11 back to the starting position of FIG. 9, the electric motor of the screw is reversed so that the carriage shifts in the direction of arrow 111. The brake 90 is released so that the belt will pass through it and the second brake 91 is actuated to lock the run 57 so that the belt will not move relative to either of the pulleys or rolls 53 or 52 of the stationary frame 50. Such a movement withdraws the extension of the run 58 back to its original size and, thus, causes a peeling action of the belt from the flap 85 as the point 110 moves around the roll 54 into the run 59. Thus, when one is emptying the contents of the bag 21, the flap 85 opens to let the contents fall into the hopper 22. If the rate of falling into the hopper 22 becomes too fast, then one can stop the movement of the retractable conveyor to stop the opening of the flap 85 or to reverse the direction so as to move the open conveyor in the direction of arrow 47 to pinch off the flow or to actually completely stop the flow closing the flap.

Figure 8:
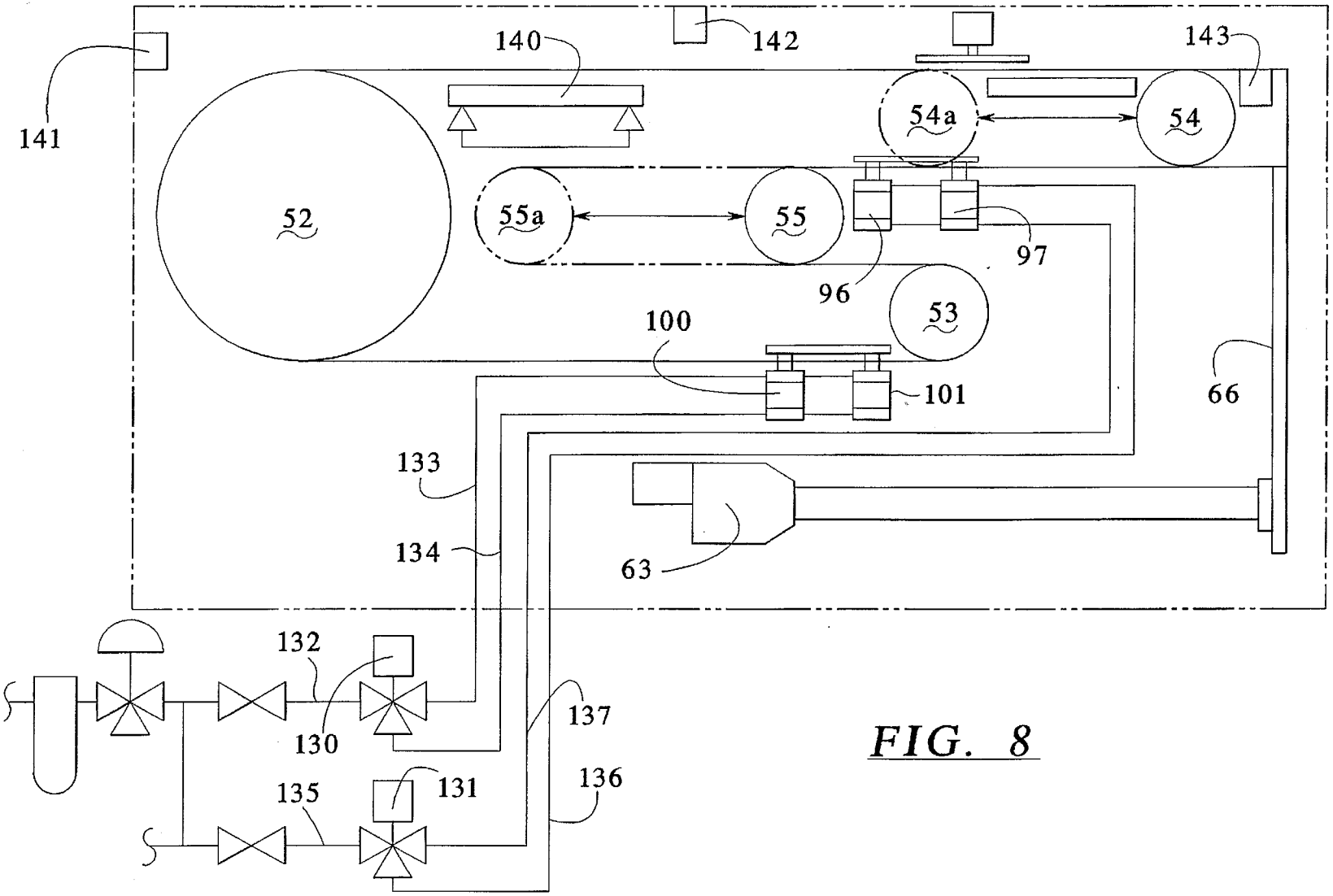
FIG. 8 is a schematic control diagram for the device of FIG. 1.

While an operator can manually control the operation of each of the conveyor means, the movable cutter to control the device, a control means 120 can be provided and follow a sequence program to actuate each of the operations in response to sensed conditions. FIG. 8 shows some of the control devices. These include solenoid valves 130 and 131 with the solenoid valve 130, which is a three-way valve which will apply a fluid medium from a line 132 to either lines 133 or 134 or not apply any fluid to either line. Thus, the brake cylinders 100 and 101 can be actuated to either cause a pinching of the belt by the brake or to release the belt. In a similar manner, the solenoid 131 connects the fluid in a line 135 to either a line 136 or 137 to actuate the cylinders 96 and 97 of the first brake 90. In a similar manner, as illustrated, a weight controller 140 is provided and, as mentioned above, stops the hoist 41 when a predetermined amount of weight is applied on the retractable conveyor. Sensors 141, 142 and 143 are also provided, with the sensor 141 determining the height of the filled bag being lifted by the hoist, as mentioned above, and provides a signal when the bag reaches a height slightly higher than the plane of the retractable conveyor. Another sensor 142 determines when the bag is in the intermediate position. The sensor 143 determines when the retractable conveyor is in the forward position.

The operation, as controlled by the controller 120, is as follows. In a first step, an operator places the bag in the pick-up position or loading position illustrated by the bag 21*a* and operates the hoist 41 to lower the bag holder 45 to a position where it can engage the bag. After hooking the straps of the bag onto the bag holder 45, the operator presses the start button for the discharge cycle on the controller 120 and the hoist 41 starts to lift the bag from the loading or pick-up position. When the bag is detected by a detector 141 to have its bottom above the level of the conveyor, the hoist is stopped and the motor of the carrier or trolley 42 is started to transport the trolley conveyor along the track or rail 43 in the direction of the arrow 47 to the intermediate position. When the leading edge or side of the bag is sensed by a photodetector, such as 142, the trolley is stopped and the hoist then lowers the bag onto the conveyor belt until the weight controller 140 reaches a preset load. At this time, the hoist is stopped and stays at this height until a later step.

The signal from the weight controller 140 also starts the stationary cutter blades, actuates the first or forward brake 90 and starts the drive of the retractable conveyor to move the conveyor to the extended position. Once the leading end of the conveyor 21 reaches a sensor 143, movement on the drive is stopped. It should be noted that while the conveyor is moving from the retracted position to the extended position, the controller has the trolley motor synchronized to move the trolley at the same speed so that the bag remains in a vertical upright position. When the belt has reached its maximum forward position, in addition to stopping the drive and trolley, the signal from the sensor 163 stops the stationary cutters, starts the transverse cutter 72 and starts the screwdrive to move the cutter 72 across the front surface of the bag. The cutter 72 stops and the transversing screwdrive stops when a detector 144 (FIG. 2) is actuated. The actuation of the detector 144 also causes the forward brake cylinder or first brake to be disengaged by the valve 131 and the valve 130 is actuated to engage the second brake. With the engagement of the second brake, the screwdrive for the carriage 51 is reversed to retract the carriage 51 to the retracted position. This retraction will cause the flap 85 to open to discharge the contents of the bag into the hopper 22.

As the carriage is withdrawn, the vibrator in the holder 45 is actuated to start shaking the bag. The vibrator runs for a controlled period of time. At the end of this, the vibrator stops and the hoist 41 raises the bag to its maximum height, which is determined by a detector 148 on the hoist 41 (FIG. 1). Once the maximum height is detected, the carrier or trolley 42 is actuated to move in the direction of the arrow 147 to the unloading station, which is outside of the frame 30. A detector (not illustrate) can be placed by the unloading station to detect when the carrier is above the unloading station and will provide a signal to start the hoist to lower the empty bag for removal. Once the bag has been removed, the operator presses a reset button and the hoist will raise the bag holder 45 and move the hoist along the track to be over the loading position. Also, during pressing of the reset button, the transverse cutter 72 will be moved back to the initial position, such as illustrated in FIG. 2, and the system is now ready to begin the next cycle.

As can be seen from the above description, the contents of a bag, such as 21, can be loaded in the hopper 22 in a fast and reliable manner without the operator coming in contact with the contents of the bag. The only contact with the bag is the attachment of the straps, such as 46, into the holder 45 and the removal of the straps from the holder 45 from the emptied bag. If a container or bag shredding device is placed at the position 21*c*, which is the removal station, the operator does not handle the bag and, thus, does not suffer problems with contact of the contents.

Thus, the unit or device can be used for handling materials which are deemed hazardous to an operator's health.

Although various minor modifications may be suggested by those versed in the art, it should be understood that I wish to embody within the scope of the patent granted hereon all such modifications as reasonably and properly come within the scope of my contribution to the art.

I claim:

1. A device for unloading large bulk bags having an upper end and a bottom interconnected by a continuous sidewall, said device comprising a frame having a portion positioned over a discharge zone, said frame having conveyor means for transporting the bag from a loading position out of the frame to an intermediate position in the frame and then to an unloading position over the discharge zone and, finally, then, to a removal position outside of the frame, said conveyor means including lift means for engaging an upper end of the bag for hoisting the bag and for holding the bag in an erect position, said conveyor means including retractable conveyor means for supporting a bottom of the bag and transporting the bag from the intermediate position to the unloading position, cutter means for cutting the sidewalls of the bag adjacent the bottom to form an opening flap at the bottom of the bag, said cutter means being positioned in the frame adjacent the unloading position, said retractable conveyor means having an end portion disposed under the bag at the intermediate position and movable with the bag into the unloading position, said end portion being retractable to open the flap to allow contents of the bag to flow into the discharge zone.

2. A device according to claim 1, wherein the cutter means includes a cutter unit mounted on each side of the frame adjacent to an entrance to the unloading position, each cutter unit comprising a motor rotating a cutting blade, a third cutting unit mounted on the frame by means for moving the third cutting unit laterally across the frame adjacent a leading end of the retractable conveyor, said third cutting unit including a motor rotating a cutting blade, so that lateral sides of the bag are cut as the bag is transported from the intermediate into the unloading position and a leading side of the bag is cut after the bag has been positioned in the unloading position.

3. A device according to claim 1, wherein the retractable conveyor means includes a fixed frame mounted in the frame of the device, a carriage mounted for movement in the fixed frame between a retracted position and an extended position, said carriage having a leading end idler roll and a second idler roll disposed at a rear of the carriage, said fixed frame having a first idler roll adjacent an entrance for the conveyor and a second idler roll mounted on the fixed frame in a position between the two idler rolls on the carriage when said carriage is in the retracted position, and a continuous belt threaded between the four idler rolls to form four runs, with one run extending between the two idler rolls of the carriage, a second run extending between the two idler rolls of the fixed frame, a run from the rear idler roll of the carriage to the forward position of the second idler roll of the fixed carriage and a fourth run for transferring the bag extending from the first idler roll of the fixed frame to the leading end idler roll of the carriage, said carriage including first brake means for engaging the belt extended in the first run, second brake means for engaging the belt in the third run, and means for shifting the carriage between the retracted position and the extended position.

4. A device according to claim 3, wherein said means for shifting includes an acme screwdrive.

5. A device according to claim 4, which includes support rollers mounted in the fixed frame adjacent the first idler roll and support rollers mounted on the carriage aligned with the support rollers on the fixed frame, said support rollers underlying the fourth run to support a bag being carried on the fourth run of the belt.

6. A device according to claim 3, wherein each of the brake means includes a pair of bars forming a throat for the belt to pass therethrough, means for shifting one bar relative to the other bar to pinch the belt therebetween to stop movement of that portion.

7. A device according to claim 1, wherein the lift means includes a trolley arrangement having a carrier movable along a track mounted in the upper portion of the frame of the device, said trolley supporting a hoist, said hoist being connected by a cable to a bag holder for gripping the upper end of the bag.

8. A device according to claim 7, wherein the bag holder includes vibrating means for shaking the bag during the unloading operation.

9. A device according to claim 1, which includes control means for operating the various portions in the device in a sequence, said control means including a detector for determining the height of the bag being lifted by the lift means, a detector for determining when the bag is in the intermediate position, a detector for determining when the bag is in the unloading position, a weight controller means for determining when a preset amount of weight of the bag has been applied to the retractable carriage at the intermediate station to stop the lowering of the bag onto the retractable conveyor and to initiate extension of the retractable conveyor.

10. A device according to claim 9, which includes detectors to determine the position of the movable cutting unit from the initial position to the final position, said detector determining the final position and starting actuation of the retracting of the retractable conveyor to start opening the bottom flap for removal of the contents of the bag.

11. A method of removing material from a bag and depositing the material into a discharge zone, said method comprising the steps of hoisting a bag above the discharge zone and placing the bag in an intermediate position on a retractable belt conveyor, while maintaining the bag in an erect position on the conveyor, transporting the bag from the intermediate position into an unloading position with the retractable conveyor and cutting lateral sides of the bag as the bag is transported between the two positions, then cutting a leading side of the bag to form a flap adjacent the bottom of the bag held with the bag by a trailing sidewall of the bag, controlling opening of the flap to control discharge of contents of the bag into the discharge zone by slowly retracting the retractable conveyor from beneath the flap, then actuating a shaker to shake the bag to insure removal of contents from the bag for a predetermined time, then removing the bag from the unloading station and lowering the empty bag down to a bag removal station.

12. A method according to claim 11, wherein the step of transporting utilizes a retractable conveyor having a movable carriage moved between a retracted position and extended position in the frame of the conveyor, said movable conveyor having first and second idler rolls and the fixed frame of the conveyor having third and fourth idler rolls with a conveyor belt wrapped around the rolls to extend from the first idler roll to the second idler roll back to the third idler roll to the fourth idler roll and back to the first idler roll, grasping the belt in a run extending between the first and second idler rolls of the carriage while moving the carriage to cause the bag on the belt to be moved twice the distance of the movement of the carriage, and then, subsequent to the step of cutting the sidewalls and the leading side to form the flap, grasping the belt in the run extending between the third and fourth idler rolls so that the belt does not move relative to the third and fourth idler rolls and a retracting of the carriage causes the belt to be slowly peeled from beneath the flap from the leading side of the bag back to the trailing side to allow the flap to open for discharge of the content.

* * * * *